United States Patent [19]

Meier

[11] Patent Number: 4,793,118

[45] Date of Patent: Dec. 27, 1988

[54] APPARATUS FOR THE FURTHER PROCESSING OF A PACKAGING LINE

[75] Inventor: Jacques Meier, Bäretswil, Switzerland

[73] Assignee: Ferag AG, Hinwil, Switzerland

[21] Appl. No.: 48,287

[22] Filed: May 11, 1987

[30] Foreign Application Priority Data

Jul. 21, 1986 [CH] Switzerland ..... 02 911/86

[51] Int. Cl.[4] ..... B65B 63/04

[52] U.S. Cl. ..... 53/118; 53/531; 242/81; 414/37; 414/42; 414/76

[58] Field of Search ..... 242/79, 81; 414/37, 414/42, 76, 744 R, 744 A; 53/116, 118, 119, 531, 430

[56] References Cited

U.S. PATENT DOCUMENTS

| | | | |
|---|---|---|---|
| 4,609,161 | 9/1986 | Weyand | 242/79 X |
| 4,637,198 | 1/1987 | Gerber | 53/118 X |
| 4,637,564 | 1/1987 | Hallenbeck et al. | 242/79 X |
| 4,697,400 | 10/1987 | Gerber | 53/118 |

FOREIGN PATENT DOCUMENTS

| | | | |
|---|---|---|---|
| 1141692 | 2/1983 | Canada | 249/79 |

OTHER PUBLICATIONS

Western Electric, Technical Digest No. 38, pp. 19-20, "Grapple for Elevating Convoluted Rolls of Material", Apr. 1975.

*Primary Examiner*—James F. Coan
*Assistant Examiner*—Steven P. Weihrouch
*Attorney, Agent, or Firm*—Armstrong, Nikaido, Marmelstein & Kubovcik

[57] ABSTRACT

The invention generally relates to a method for ordering a coherent packaging line for storing in storage units or for intermediate buffering during a packaging process, wherein prior to the cutting into product portions, the packaging line discharged at the full process speed is wound onto winding plates and the winding formed is intermediately stored, so that then further process stages can be performed thereon, e.g. a singling or cutting at a random time and at a random process speed. The apparatus performing the method has a winding plate drive and winding plates drivable by it for winding a coherent packaging line, together with a supply mechanism for supplying empty winding plates to the winding plate drive and a conveying means for supplying a packaging line to the winding plates. Several supply means can be associated with one winding plate drive.

14 Claims, 5 Drawing Sheets

APPARATUS FOR THE FURTHER PROCESSING OF A PACKAGING LINE

BACKGROUND OF THE INVENTION

The present invention is in the field of product transportation of conveying technology in a high speed production and packaging process and relates to a product transfer process within the overall manufacturing process, particularly the taking over of products discharged from a machine and the delayed transfer to the manufacturing stage. In a specific embodiment, the product transfer process is directed at the discharge of goods packaged in a flow pack procedure.

A typical high speed manufacturing process, e.g. in chocolate manufacture starts with raw materials, which are generally automatically supplied to the production process from bin storage. Grinding, mixing, etc. take place fully automatically, whilst mixing and stirring are generally automated production processes. An intermediate batch operation, e.g. the emptying of the stirrers into containers with a capacity of up to 70 tonnes of chocolate material admittedly interrupts the continuous material flow, but does not alter the high mass potential of the manufacturing process. The first bottleneck problems in the case of high material throughout occur in the following injection, pouring or moulding process, in which the unshaped material is to be converted into lump, i.e. portion form.

As a result of the amorphous presence of the intermediate products, up to this point the production process of the material flow can be controlled by using simple means, usually pipe connections, which permit a relatively simple pipelining, which is especially suitable for fully automatic material transfer, it is no longer possible to transfer with mass product transportation method lumpy products, or preferably the portioned product so as to bring about a distinction between e.g. lump coal, which can also be pipeline-transferred.

The bottleneck problems increase particularly in the packaging section of the manufacturing process, in which in a single packaging line, e.g. a discharge of 50 tonnes/day in e.g. 0.0001 t portions make it necessary to control 500,000 packaging processes. Generally several such packaging lines are installed and also simultaneously operated.

If at the time of portioning the material flow was split up into several injection lines, so as to avoid bottlenecks by simultaneous, parallel operations, this becomes unavoidable in the case of the serial process of packaging. Thus, each injection line is followed by several parallel-operating packaging lines, in which the chocolate bars (portions) produced in this example are packed by a flow pack process developed for high packaging speeds. Generally the flow pack line is subsequently cut into portions and the loose individual products are collected in some way.

This is where the inventive idea comes into play. Normally the material flow of packed products, in this case chocolate bars, are either fully automatically or manually further processed. Often this takes place by human hand, e.g. by standard packing in boxes and the like, so that a difficult to handle multiple form (chocolate bars) is brought into an easier to handle, but more complicated smaller form (boxes). No matter what packaging procedure is adopted, singling to give packable portions breaks up excessively early a process-inherent order or arrangement.

Process-inherent order means that different operating stages are performed at different points, which in certain circumstances can be very close or very far from one another. The material must be conveyed between the individual operating or processing stages, which e.g. involve position changes and the like. They are to be looked upon as linking operations on the next process step and represent a given (transient) order in the overall flow. A disturbance to this order disturbs the sequence and a removal of said order blocks the sequence. Ordering actions can be looked upon as "introduced" ordering, collating or arranging elements. Process-inherent ordering elements are, however, hidden in the process sequence, but must be specifically sought for utilization purposes. They are rarely obvious and are usually so rare that often additional ordering elements are introduced into a process, where it would in fact be possible to use a process-inherent order. Thus, a process-inherent order is removed by an additional production stage and is replaced by an "introduced" ordering element.

SUMMARY OF THE INVENTION

The invention solves the problem of providing a method for the temporary storage of a packaging union or flow pack or hose bag, in which such ordering elements are used and therefore the transfer of the packaged material into the following processing stage is improved, the method being particularly intended for high speed packaging processes.

A further problem of the invention is to provide suitable means for performing the method.

An example of the use of process-inherent ordering elements is illustrated by the further processing of a flow pack output of chocolate bars. However, the invention is in no way limited to the nature of the packaged product and it can in fact relate to any coherent packaging line with portioned products.

The solution of the inventive problem is shown on this specific example and is described by the invention defined in the claims.

This specific use of the inventive process and a specific embodiment of an apparatus for performing it is described in greater detail hereinafter relative to the drawings.

DETAILED DESCRIPTION OF THE INVENTION

Figure 1:
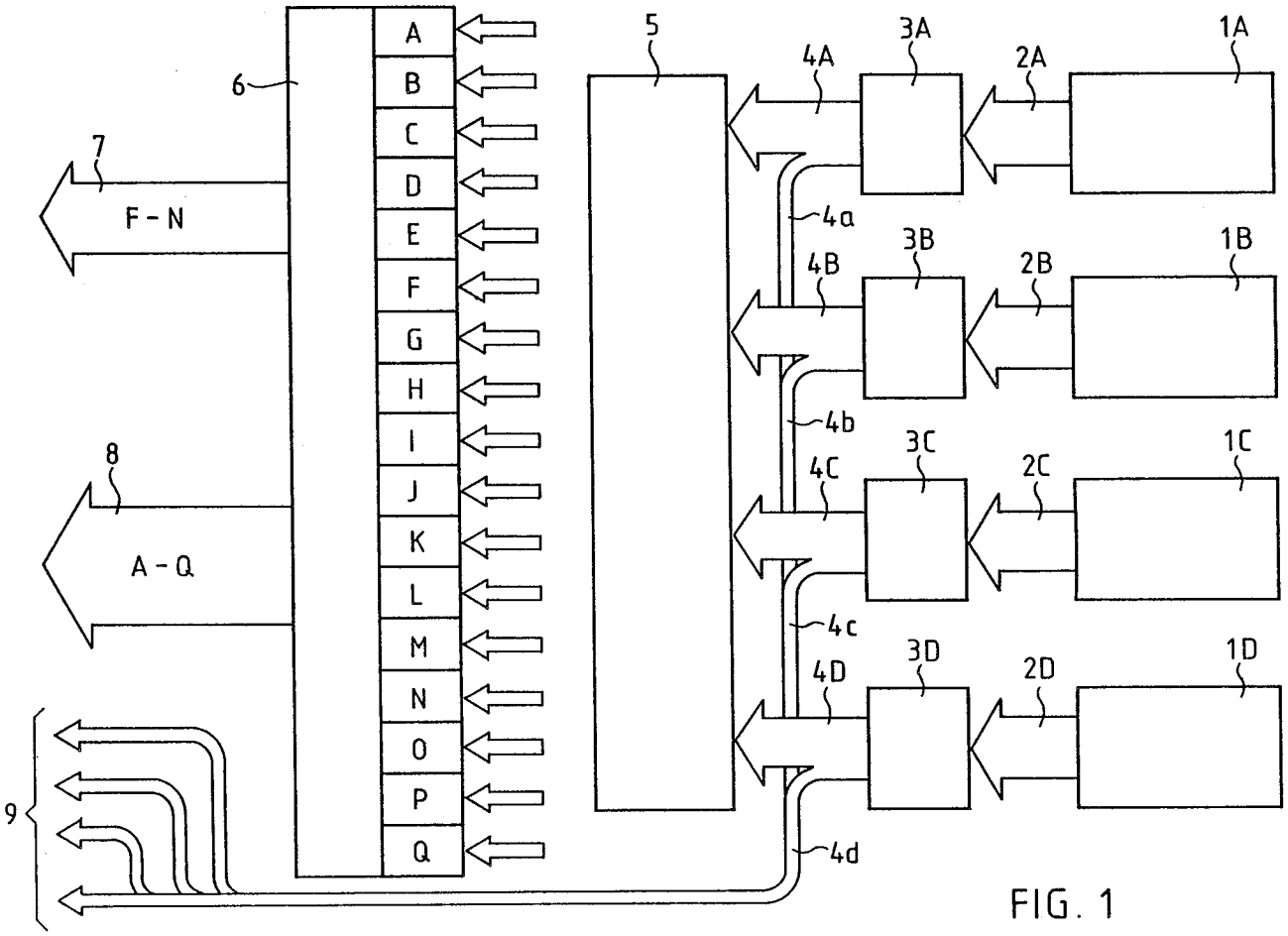
FIG. 1 is a diagram of material flow in the manufacture of a product.

FIG. 1 shows the final stations of a material flow in a manufacturing process and namely as from the portioning of a basic material (chocolate) and the associated subdivision into simultaneously functioning production lines. This parallelization starts at the bar means 1A to 1D, which receive a pasty material flow of e.g. 22.5 t/h and process the same into given portions. Each bar means operates on in each case one packaging means 3A to 3D, each of the said packaging means possibly comprising several parallel-operating packaging lines. In the packaging lines the product is enveloped in the flow pack process, a type of hose bag pack at a high processing speed. The packaging rate in a packaging line and therefore the output thereof is typically 1.0 to 1.5 m/s. The product flows 4A/*a* to 4D/*d* at the outlet of the packaging units will be as follows. A small product flow 4*a* is e.g. supplied at the full discharge rate to an automatic large pack 9, a larger product flow 4A cannot for some reasons be automatically packed and must therefore be intermediately stored for later packing.

Thus, the problem arises for the larger product flow 4A of further processing, e.g. in a type mixing line 6 and/or temporary storage in e.g. a temporary store 5 for subsequent further processing in a type mixing line. This intermediate storage serves as a time buffer. This can also include conveying over long or short distances. The method according to the invention permits such intermediate buffering operations through the use of process-inherent ordering elements in a virtually random manner, in that when they are used in the case of full product output the transfer rate is temporarily reduced or stopped, so as to pass same to another location with a different process speed. This is indicated by the type mixing line 6, in which types A to Q are mixed in e.g. two material flows 7, 8. Material flow 7 e.g. contains types F to N and material flow 8 types A to Q. Generally such large packaging units contain 100 kg and more of chocolate, consisting of all types or a selected part thereof.

Figure 2A:
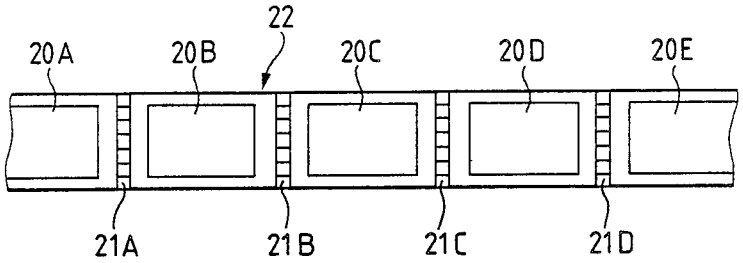
FIG. 2*a* and 2*b* show part of a packaging line (e.g. flow pack) in plan and side view for explaining the object involved in the discussed method.
Figure 2B:
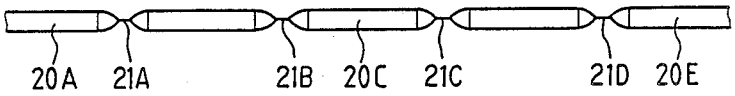

From two observation directions, FIGS. 2 a/b show a typical hose bag pack with individual portions 20A to 20E, which are housed in a "packaging hose or tube" 22. The individual portions are separated from one another in the hose by closure zones 21A to 21D. In the conventional flow pack process, a cutting device controlled at the process speed separates into portions the flow pack union 22 roughly centrally in the closure zones. This singling or portions was hitherto considered to be unavoidable, because in the case of discharge rates of 1 to 1.5 m/s, it was not possible to control the coherent flow pack union (material flow).

However, the present invention avoids this singling, in order to obtain and use a process-inherent order. There is no cutting process at this point in the processing operation and the high speed of the material flow is reduced or even stopped by winding up the flow pack union. An uncut or intact closure zone 21 is to be looked upon as a process-inherent ordering element. All the intact closure zones 21A, 21D, 21N order, arrange or collate the packed portions in a definite row in the form of a strand-like union.

Figure 3:
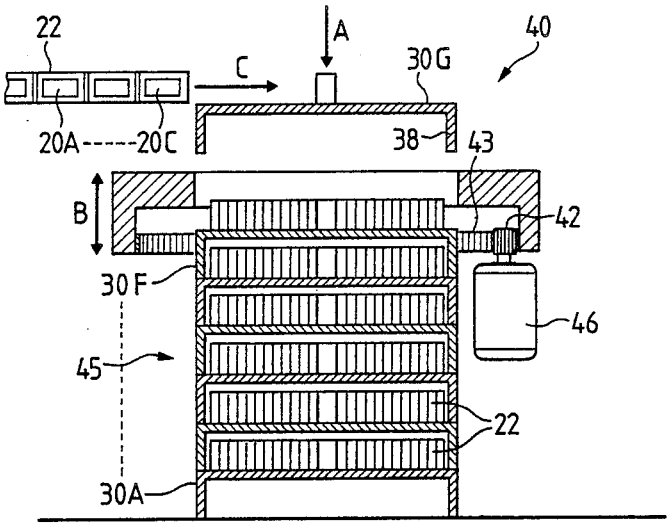
FIG. 3 shows an embodiment of long packaging lines brought together to form a storage tower and wound onto winding plates and a stylized winding drive for the same.

For the purpose of winding up the packaging strands or lines, use is made of winding plates onto which the winding line is wound from inside to the outside. The winding plates preferably have a disk-like, circular shape, the diameter being matched to the product and storage capacity. The winding plates can be stacked and in specific embodiments can have a flat or slightly curved plate bottom. For the fundamental representation of the inventive method, FIG. 3 shows a raisable and lowerable winding plate drive 40 in which, for loading purposes, the plates can be fixed or inserted vertically from the top or bottom. The fully wound winding plates 30A to 30F released by the winding drive 40 can be stacked to form a storage tower 45, which when placed on a standard pallet can be manipulated by conventional conveying or transporting means. The flow pack union is wound in considerable lengths and the individual windings or coils are stacked on one another on their winding plates. In this way a very dense volume storage form of unsingled products is obtained. The product form is substantially the same as in the production process, so that on such an intermediately stored product, it is possible at any time to resume the process in the process phase in which it was interrupted.

The plate drive 40 can be raised and lowered in the same way as the fork of a fork-lift truck (arrow B). Driving takes place e.g. by an electric motor 46 with a pinion 42 via an internal gear 43. Below its internal recess a storage tower 45 with completely wound winding plates 30A to 30F stands on the bottom. The winding plate drive 40 is raised somewhat over the finished (top) flow pack winding, so that an empty winding plate 30 can be introduced from above into the drive. Following fixing, the packaging line 22 running in in sloping manner from the left in the drawing (arrow C) is threaded and the plate is rotated for winding purposes. During the winding process the winding plate remains "fixed" in the winding plate drive and as soon as it is completely wound it is placed on the preceding, completely loaded winding plate of storage tower 45. After the filling of the last, top winding plate, the winding plate drive is raised to such an extent (double arrow B), that it can be swung away over the storage tower 45, or the storage tower can be moved away under it. The winding plate drive is then lowered to such an extent that it is again ready for filling a new storage tower.

The winding plate drive 40 rotates winding plate 30, so that a supplied flow pack line is successively wound. To facilitate understanding of the representation, the portions are correspondingly designated. The presently shown winding plates 30 can have a side length of approximately 2 to 3 meters, but the stack supports 38 are only 15 cm high. The means are not shown which are necessary for producing the necessary strength of the plate, such as reinforcements, struts etc, so that it can be used for a palletized material carrying capacity of 200 to 300 kg. An apparatus for threading the packaging line is described in greater detail hereinafter.

As winding plates are "displaceable", the manufacturing expenditure per plate must be as low as possible, i.e. a winding plant must have the maximum number of functions directly on the winding plate drive 40 and the actual winding plates will only have the elements necessary for loading, unloading and storage. All other functions are to be fulfilled by the central winding plate drive 40, whereof only small numbers need be provided, as compared with the large number of winding plates.

Figure 4:
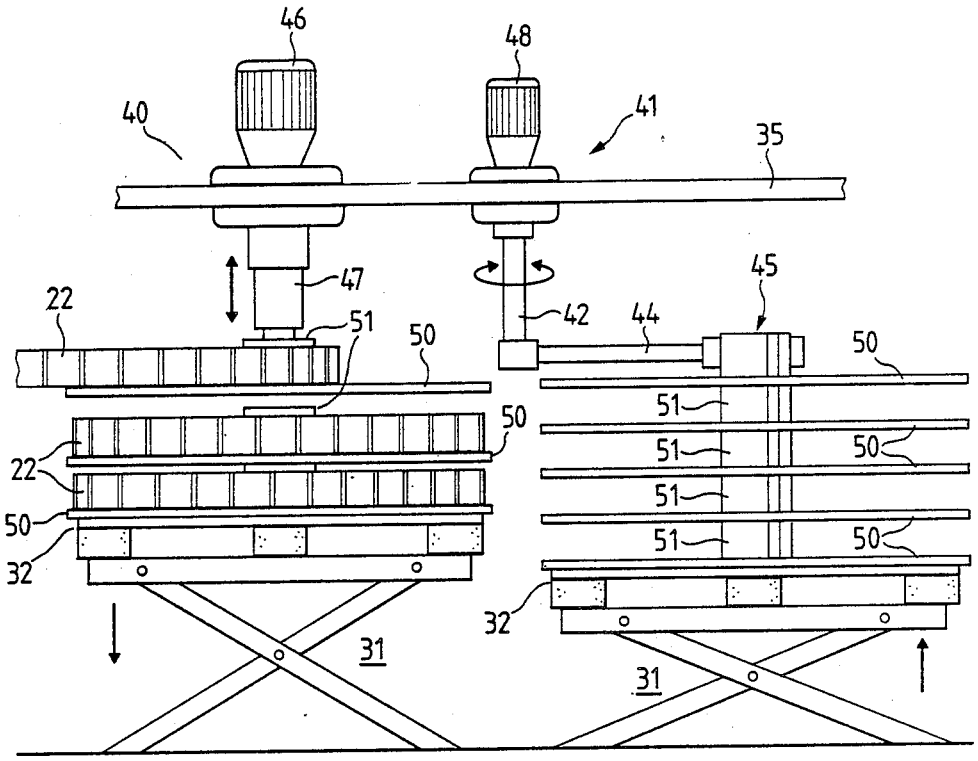
FIG. 4 also shows a stylized winding means (for winding on and off) for long packaging lines.

FIG. 4 specifically shows a plant for winding up or unwinding a flow pack union 22. A plurality of winding plates 50 is stacked on standard pallets 32 on a lifting platform 31 shown in stylized form. On the right-hand lifting platform is provided a stock of empty winding plates for winding purposes, whilst the left-hand lifting platform carries a superimposed stack of wound winding plates. Above the same and arranged on a support structure 35 is provided a winding plate drive 40, together with a supply mechanism 41. The winding plate drive 40 essentially comprises a drive motor 46 and a pneumatic shaft 47 fixed thereto so that, apart from the rotary movement for winding purposes, it can perform a raising and lowering movement towards and away from the storage tower. The winding plates 50 can be fixed on their winding core 51 on said pneumatic shaft. The supply mechanism 41 essentially comprises a drive motor 48 for driving a swivel shaft 42, on which is provided a swivel arm 44 with a gripping device 45 for fixing the winding core 51 of an empty winding plate 50. One or more winding plate drives 40 are so arranged with respect to the supply mechanism 41 that with the swivelling movement performed, the winding plates can be positioned in axially correct manner under the winding plate drive. In this example, supply mechanism 41 only supplies one winding plate drive 40, but it could equally well supply two winding plate drives.

The plant functions as follows. Both the wound and the empty winding plates are stacked upon one another and thus form, as stated hereinbefore, an easily manipulatable storage tower with unsingled hose bags (flowpack). For this purpose, each tower is preferably placed on a standard pallet, so that it can be easily transported e.g. with fork-lift trucks. The standard pellets for empty winding plates to a storage and for receiving wound plates from such a tower, are placed on in each case one lifting platform 31. The two lifting platforms move in opposite directions. Whilst one lifting platform supplies empty winding plates and rises in stepwise manner, the other lifting platform receives wound winding plates and thereby drops in stepwise manner. With supply mechanism 41 the top winding plate 50 is raised from the tower, swivelled to the winding plate drive 40, coupled to pneumatic shaft 47 and rotated. The strip-like flow pack union 22 is then supplied to the reception-ready winding plate 50, is received by its winding core 51 and is wound. Details of the supply, threading, etc will be discussed relative to further drawings. It is assumed that the construction of the pneumatic shaft 47, drives 46, 48 of winding plate drive 40 and supply mechanism 41, the construction of the lifting platforms and the control thereof are known to the Expert and will consequently not be described in detail.

In the represented manner it is possible to obviate the process-prejudicial singling and this can be carried out with flow operation operating at full processing speed. With an identically constructed winding plant, it is possible to reverse the process (unwinding) for further processing purposes, i.e. postponed singling for packaging is possible. The fully wound winding plates are thereby raised from a storage tower 45 with the supply or removal means 41 and same are supplied to the winding or unwinding means 40. This will lead to a tower with empty winding plates for further use.

For fully supporting a flow operation, the above-described winding process must be performable at any time, although winding and the formation of storage towers are batch operation-like processes. In order to achieve this, in alternating operation, at least two of the above-described winding plants must be provided for each packaging machine. Such a tandem apparatus with product supplies is shown from above in FIG. 5.

Figure 5:
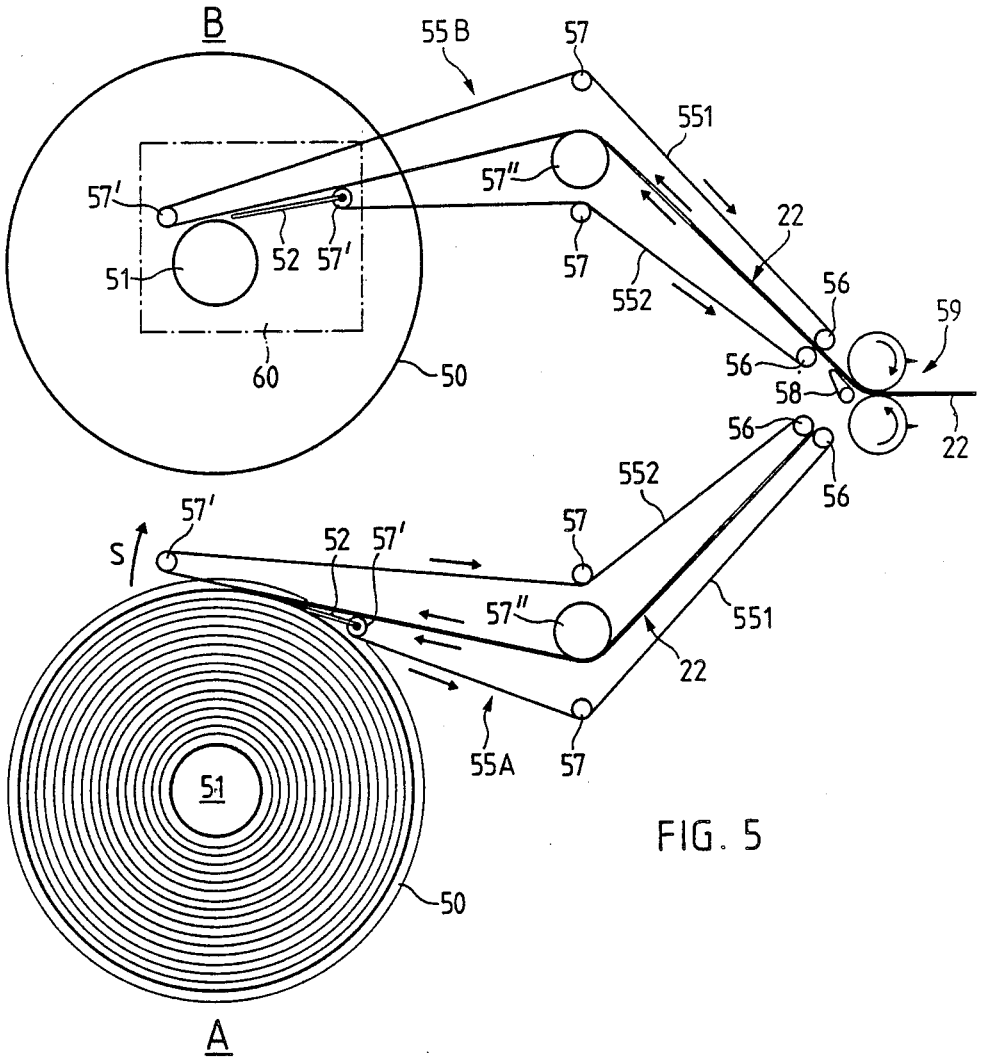
FIG. 5 shows a tandem apparatus for winding a packaging line running in continuously at high speed.

FIG. 5 shows two winding plates 50 without their winding plate drive 40 and the supply mechanism 41 for the empty winding plates 50. A just completely wound winding plate is A and a ready, but still empty winding plate is B and is just charges with a flow pack union 22. This function is fulfilled by transporting or conveying means 55A, 55B for the flow pack union 22 and associated with the winding plates and in the present example there is a tandem apparatus, which is alternately put into operation.

Conveying means 55A, 55B essentially comprises driven endless belts 551, 552 running over drive and also guide pulleys 56, 57, 57', 57'', between which is supplied the flow pack union 22 with winding plate 50. These two conveying means are designated 55A and 55B in accordance with their instantaneous operating position and in the present case are identical. An outer conveyor belt 551 and an inner conveyor belt 552 are guided as endless belts over drive and guide pulleys 56, 57, 57', 57'' and driven by drive pulleys 56. The front part of the conveying means with the guide pulleys 57' and facing the winding plate is pivotable and can in this case be pivoted about the guide pulley 57''. A pressing means 52 is associated with the front part of the conveying means, so as to ensure the conveying of the start of the packaging line (flow pack union), also in the rocker pressing region. Reference will be made hereinafter to the problem of threading this start. At the other end, the rear part of the conveying means with drive pulleys 56, is provided a guide member 58, which supplies the flow pack union 22 running through a cutting mechanism 59, after cutting, to the still empty winding plate to be filled. Reference numeral 60 defines a zone, which in conjunction with FIG. 6 shows the threading of the flow pack union in winding core 51 of winding plate 50.

The apparatus according to FIG. 5 functions as follows. The instantaneous picture shows the winding process change from a fully wound winding plate A to a ready, empty winding plate B. The pivotable part of conveying means 55A engages on the periphery of the winding in the direction of pivot arrow S. A residual part of the wound flow pack union 22 separated by the cutting process in cutting mechanism 59 is still running into the now finished winding. The new start of the separated flow pack union 22 formed in this way is deflected by guide member 58, runs into conveying means 55B and is now supplied to the empty winding plate B. Conveying means 55B engages on winding core 51 with the pivotable front part in the threading position and said core receives the incoming flow pack union. The winding plate then passes into winding operation. During the winding on winding plate B, the fully wound winding plate A, as stated in conjunction with FIG. 4, is lowered by means of the pneumatic shaft onto the storage tower and is replaced by supply mechanism 41 by a new, empty winding plate. Up to the resumption of winding operation, the conveying means 55A remains in readiness swung in on winding core 51 for the threading of the flow pack strip to be separated in flow operation. The control of the cutting mechanism 59 and guide member 58 takes place by means of sensors, which either scan the winding state of the winding, or the position of the pivotable part of the conveying means.

FIGS. 6 A/B/C show an embodiment of an apparatus 60 for threading the flow pack union 22 on winding core 51 of winding plates 53. The three drawings show on the same apparatus three successive operating states, relative to which the function of the apparatus ia also discussed.

Figure 7:
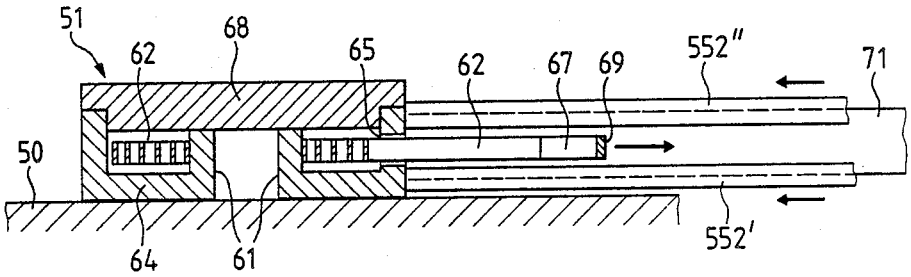
FIG. 7 shows a part sectional representation of the threading apparatus according to FIG. 6A.
Figure 6A:
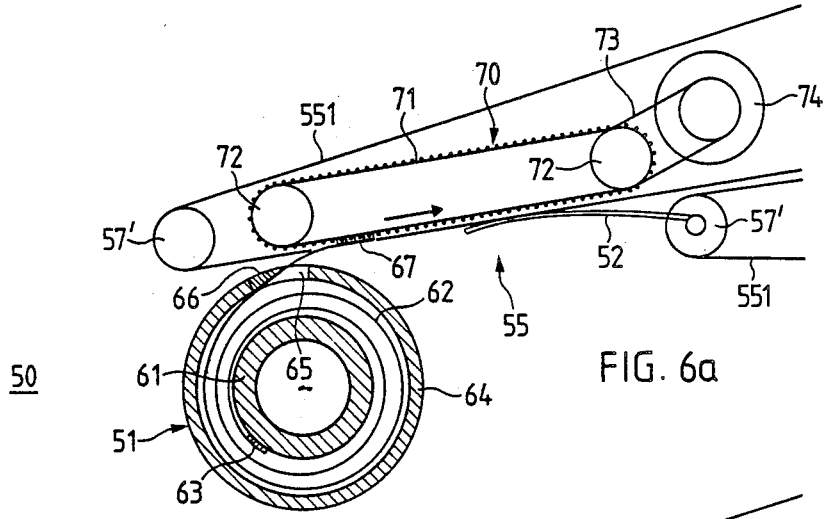
FIGS. 6A, 6B, and 6C show a detail of a winding plate, an apparatus for threading the entering packaging line—product entry being shown in three phases.
Figure 6B:
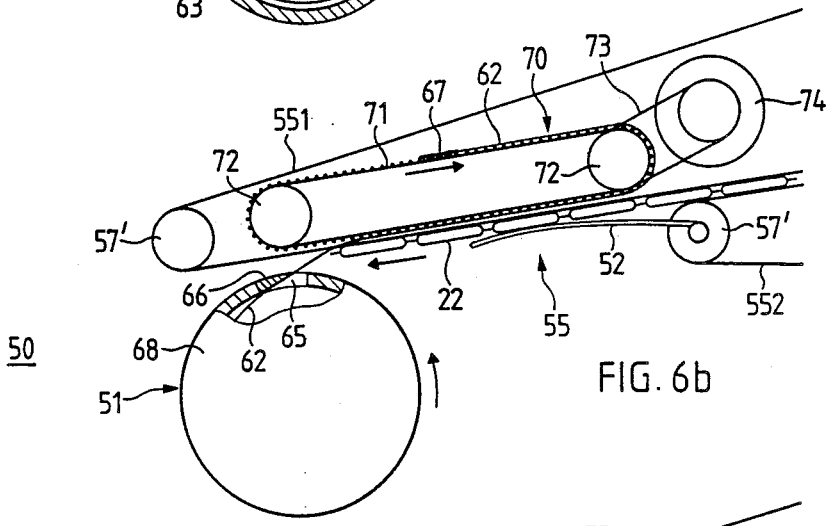
Figure 6C:
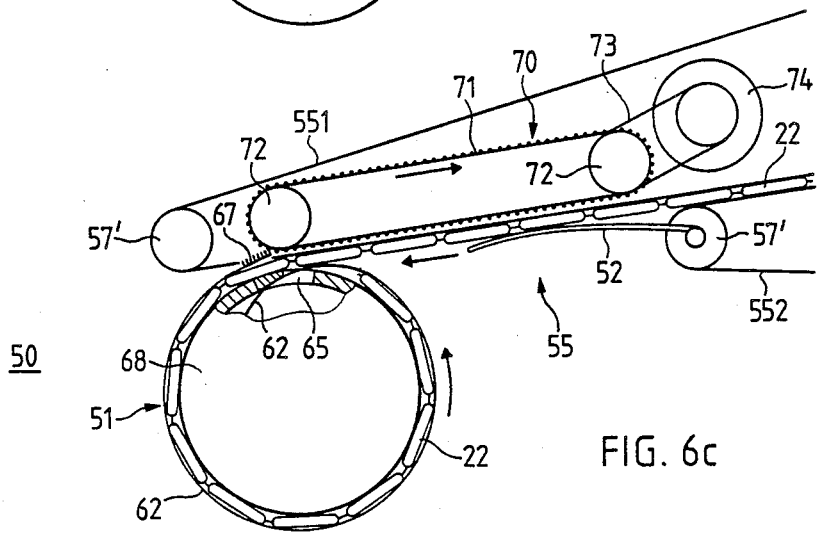

The apparatus according to FIG. 6 A shows the front, pivotable part of the conveying means 55 with guide pulleys 57' and guide member 52. Winding core 51 is constructed here in much the same way as a watch case. A spiral spring 62 with fastening means 63 is fixed to the spring core 61 and is placed in several, still loose turns around the latter. A casing 64 covering the spring core and the spring, e.g. with a cover 68 for checking and servicing purposes, has a slot-like opening 65 for the exit of the spiral spring 62 and on one side of which is provided a guide or slide wedge 66. At the unfixed end, the spiral spring 62 is drawn out of the spring housing and has suitable means 69 to ensure that the spring cannot be completely retracted into the housing despite the restoring force acting thereon (e.g. in the form of a stop member). The end of the spiral spring remaining outside the spring housing, as shown in FIG. 7, is fixable to an additional auxiliary device 70 by a coupling means 67, which can be detached by a pulling movement. This auxiliary device 70 comprises a motor-driven endless belt 71, which is guided about two guide pulleys 72 and is e.g. driven by a motor 74 via a drive cord 73. In this case the coupling means 67 can comprise a known burr closure (but a holding magnet is also suitable), which can be easily detached by exerting little force by merely tearing off and can be joined again as required to the endless belt 71. Endless belt 71 is used for drawing out the spiral spring from the spring housing in the direction of the arrow (opposite to the conveying direction of belt 552), accompanied by the simultaneous storage of the restoring force. The drawn out spiral spring completely covers endless belt 71 in its width and part of its length. In order to permit a short construction of this auxiliary device, conveyor belt 55 is subdivided into spaced, parallel belts 552', 552'', between which is arranged the endless belt 71 (FIG. 7). Thus, on drawing out spiral spring 62, use can also be made of the back of endless belt 71, on which engages a coupling means 67 positioned on the spiral spring (cf FIG. 6C). The control of the auxiliary device takes place in accordance with a procedure known to the Expert.

Whereas FIG. 6A shows the threading apparatus 60 in its readiness position, in FIG. 6B it is already in action in order to thread an incoming flow pack union 22 onto winding core 51. In its preparatory phase shortly beforehand, auxiliary device 70 draw out from the spring housing spiral spring 62 fixed to endless belt 71 by somewhat more than the length of the winding mandrel circumference. The front part of the incoming flow pack union 22, driven by belts 552' 552'' and held by pressing means 52, runs on spiral spring 62. Substantially simultaneously winding core 51 starts to rotate counterclockwise (rotation arrow) and the auxiliary device 70 brings spring 62 through a direction reversal of endless belt 71 back in the direction of the spring housing or to the winding mandrel. During this process the flow union 22 is gently pressed onto the winding core rotating in the winding up direction and the spiral spring drawn by somewhat more than a circumference length from the spring housing and which is still fixed to the endless belt 71 of the auxiliary device, ensures that the flow pack union remains pressed against the winding core.

This part of the process can be very well seen in FIG. 6C, in which a first wound layer of the flow pack union 22 is shown around winding core 51. The detachable coupling means 67 fixed to spiral spring 62 is about to become detached from the still rotating endless belt 71. The spiral spring part serving as a winding aid will also briefly be detached from the first wound layer and is then partly wound in between the first and second wound layers. During the subsequent unwinding of the wound product, said spiral spring part is again retracted into the spring housing and can thus be brought back into the initial position, as shown in FIG. 6A.

The invention generally relates to a method for ordering a coherent packaging line for storage in storage units or for intermediate buffering during a packaging process and which is characterized in that prior to cutting into product portions the packaging line supplied at the full process speed is wound onto winding plates and the winding formed is intermediately stored and it can then be supplied to further process stages, e.g. an intended singling at a random time end at a random process speed. The apparatus performing this method is characterized by a winding plate drive 40 and winding plates 50 driven by it for winding a coherent packaging line 22, as well as a supply mechanism 41 for supplying empty winding plates 50 to the winding plate drive 40 and a conveying means 55A, 55B for supplying a packaging line 22 to winding plates 50. Several supply means 41 can also be associated with a single winding plate drive 40.

What is claimed is:

1. An apparatus in a packaging process for ordering and storing a coherent packagine line, before cutting said line into individual product portions, said apparatus comprising:

a plurality of winding plates each having a central core around which said coherent packaging line is wound;

a supply means for supplying empty winding plates to a predetermined loading position to receive said coherent packaging line;

a winding plate drive means for driving each winding plate supplied to said predetermined loading position in order to wind said coherent packaging line on said plate; and a conveying means for conveying said coherent packaging line discharged from a previous processing station at full process speed to a winding plate positioned at said loading position.

2. The apparatus of claim 1, wherein said supply means includes a plurality of supply mechanisms for supplying winding plates to and from said predetermined loading position.

3. The apparatus of one of claims 1 or 2 further comprising raisable and lowerable platforms for receiving and supporting empty and full winding plates from said supply means.

4. The apparatus of claim 3, wherein said winding plate drive means includes an axially displaceable pneumatic drive shaft to engage and disengage with a winding plate in said loading position.

5. The apparatus of claim 3, wherein said supply means includes a supply mechanism having a gripper attached to an arm which is attached to a swivel shaft, such that said gripper grips a winding plate for moving said winding plate to and from said loading position.

6. The apparatus of claim 1, wherein said conveying means includes a pair of driven conveyor belts for conveying said coherent packaging line therebetween, wherein each conveyor belt has guide and drive pulleys.

7. The apparatus of claim 6, wherein said drive pulleys are fixed and said guide pulleys are pivotable.

8. The apparatus of one of claims 6 or 7, wherein said conveying means includes an auxiliary means for threading said packaging line on to a winding plate.

9. The apparatus of one of claims 1, 6 or 7, wherein the central core of said winding plates includes a belt means for operatively connecting with a pulling means on said auxiliary device, and for threading said packaging line.

10. The apparatus of claim 9, wherein said belt means includes a spiral spring wound in said central core, and having an end extending out from said central core and having a coupling means detachably engageable with said pulling means on said auxiliary device.

11. The apparatus of claim 10, wherein said coupling means of said spiral spring forms one part of a burr closure and said pulling means in the form of an endless belt forms the other part of the burr closure.

12. The apparatus of claim 3, wherein a pallet, for supporting said winding plates on one of said platforms, has a flat pallet bottom.

13. The apparatus of claim 3, wherein a pallet, for supporting said winding plates on one of said platform, has a sloping pallet bottom.

14. The apparatus of one of claims 1, 6 or 7, wherein said conveying means has a cutting mechanism with a following guide member.

* * * * *